US007852010B2

(12) United States Patent
Negley

(10) Patent No.: US 7,852,010 B2
(45) Date of Patent: Dec. 14, 2010

(54) LIGHTING DEVICE AND METHOD OF LIGHTING

(75) Inventor: Gerald H. Negley, Durham, NC (US)

(73) Assignee: Cree, Inc., Durham, NC (US)

( * ) Notice: Subject to any disclaimer, the term of this patent is extended or adjusted under 35 U.S.C. 154(b) by 807 days.

(21) Appl. No.: 11/755,162

(22) Filed: May 30, 2007

(65) Prior Publication Data

US 2007/0279440 A1 Dec. 6, 2007

Related U.S. Application Data

(60) Provisional application No. 60/809,595, filed on May 31, 2006.

(51) Int. Cl.
*H05B 37/00* (2006.01)

(52) U.S. Cl. ..... 315/185 R; 315/169.3; 315/192

(58) Field of Classification Search ..... 315/169.1, 315/169.2, 169.3, 185 R, 191, 192, 193; 362/800; 345/82, 83, 84

See application file for complete search history.

(56) References Cited

U.S. PATENT DOCUMENTS

| | | | |
|---|---|---|---|
| 3,787,752 | A | 1/1974 | Delay |
| 4,859,911 | A | 8/1989 | Kinnard et al. |
| 5,128,595 | A | 7/1992 | Hara |
| 5,661,645 | A | 8/1997 | Hochstein |
| 5,783,909 | A | 7/1998 | Hochstein |
| 6,016,038 | A | 1/2000 | Mueller et al. |
| 6,051,935 | A | 4/2000 | Bucks et al. |
| 6,150,774 | A | 11/2000 | Mueller et al. |
| 6,236,331 | B1 | 5/2001 | Dussureault |
| 6,329,758 | B1 | 12/2001 | Salam |
| 6,329,760 | B1 | 12/2001 | Bebenroth |
| 6,329,764 | B1 | 12/2001 | van de Ven |
| 6,359,392 | B1 | 3/2002 | He |
| 6,362,578 | B1 | 3/2002 | Swanson et al. |
| 6,388,393 | B1 | 5/2002 | Illingworth |

(Continued)

FOREIGN PATENT DOCUMENTS

| | | |
|---|---|---|
| EP | 1 033 903 | 9/2000 |
| JP | 2006-242733 | 9/1994 |
| WO | 01/63977 | 8/2001 |
| WO | 2004/060023 | 7/2004 |

OTHER PUBLICATIONS

U.S. Appl. No. 12/328,144, filed Dec. 4, 2008.

(Continued)

*Primary Examiner*—David Hung Vu
(74) *Attorney, Agent, or Firm*—Burr & Brown

(57) ABSTRACT

A lighting device, comprising at least first and second current regulators, each switchable among two settings, and at least first and second groups of solid state light emitters. If the first regulator is in a first setting, a first current is supplied to the first group and a second current is supplied to the second group, and if the first regulator is in a second setting, a third current is supplied to the first group and a fourth current is supplied to the second group. In some embodiments, a ratio of the third current divided by the first current differ's from a ratio of the fourth current divided by the second current by at least 5%. Also, a method comprising substantially simultaneously adjusting current supplied to a first group, and adjusting a current supplied to a second group.

32 Claims, 6 Drawing Sheets

U.S. PATENT DOCUMENTS

| | | | | |
|---|---|---|---|---|
| 6,459,919 | B1 | 10/2002 | Lys et al. | |
| 6,495,964 | B1 * | 12/2002 | Muthu et al. | 315/149 |
| 6,552,495 | B1 | 4/2003 | Chang | |
| 6,577,072 | B2 | 6/2003 | Saito et al. | |
| 6,616,291 | B1 | 9/2003 | Love | |
| 6,630,801 | B2 | 10/2003 | Schuurmans | |
| 6,788,011 | B2 | 9/2004 | Mueller et al. | |
| 6,806,659 | B1 | 10/2004 | Mueller et al. | |
| 6,836,081 | B2 | 12/2004 | Swanson et al. | |
| 6,858,994 | B2 | 2/2005 | Vollrath | |
| 6,965,205 | B2 | 11/2005 | Piepgras et al. | |
| 6,975,079 | B2 | 12/2005 | Lys et al. | |
| 7,014,336 | B1 | 3/2006 | Ducharme et al. | |
| 7,015,654 | B1 | 3/2006 | Kuhlmann et al. | |
| 7,038,399 | B2 | 5/2006 | Lys et al. | |
| 7,180,252 | B2 | 2/2007 | Lys et al. | |
| 7,213,940 | B1 | 5/2007 | Van De Ven et al. | |
| 7,255,457 | B2 | 8/2007 | Ducharme et al. | |
| 7,274,160 | B2 | 9/2007 | Mueller et al. | |
| 7,276,861 | B1 | 10/2007 | Shteynberg et al. | |
| 7,301,288 | B2 | 11/2007 | Green | |
| 7,323,828 | B2 | 1/2008 | Russell et al. | |
| 2001/0024112 | A1 | 9/2001 | Jacobs et al. | |
| 2002/0145392 | A1 | 10/2002 | Hair, III et al. | |
| 2003/0011559 | A1 | 1/2003 | Adachi et al. | |
| 2005/0035728 | A1 | 2/2005 | Schanberger et al. | |
| 2006/0139954 | A1 | 6/2006 | Kobori et al. | |
| 2006/0176411 | A1 | 8/2006 | Furukawa | |
| 2008/0048582 | A1 | 2/2008 | Robinson | |

OTHER PUBLICATIONS

U.S. Appl. No. 11/939,059, filed Nov. 13, 2007.
Craig DiLouie, *Dimming HID lamps can produce significant energy savings and increase user flexibility*, HID Lamp Dimming, Oct. 1, 2004, 6 pages.
U.S. Appl. No. 11/613,692, filed Dec. 20, 2006.
U.S. Appl. No. 11/614,180, filed Dec. 21, 2006.
U.S. Appl. No. 11/613,714, filed Dec. 20, 2006.
U.S. Appl. No. 11/613,733, filed Dec. 20, 2006.
U.S. Appl. No. 11/624,811, filed Jan. 19, 2007.
U.S. Appl. No. 11/626,483, filed Jan. 24, 2007.
U.S. Appl. No. 11/743,754, filed May 3, 2007.
U.S. Appl. No. 11/751,982, filed May 22, 2007.
U.S. Appl. No. 11/753,103, filed May 24, 2007.
U.S. Appl. No. 11/751,990, filed May 22, 2007.
U.S. Appl. No. 11/736,761, filed Apr. 18, 2007.
U.S. Appl. No. 11/736,799, filed Apr. 18, 2007.
U.S. Appl. No. 11/737,321, filed Apr. 19, 2007.
U.S. Appl. No. 11/755,153, filed May 30, 2007.
U.S. Appl. No. 11/856,421, filed Sep. 17, 2007.
U.S. Appl. No. 11/859,048, filed Sep. 21, 2007.
U.S. Appl. No. 11/936,163, filed Nov. 7, 2007.
U.S. Appl. No. 11/843,243, filed Aug. 22, 2007.
U.S. Appl. No. 11/948,021, filed Nov. 30, 2007.
U.S. Appl. No. 11/939,052, filed Nov. 13, 2007.
U.S. Appl. No. 11/736,799, filed Apr. 18, 2007.
U.S. Appl. No. 11/877,038, filed Oct. 23, 2007.
U.S. Appl. No. 11/870,679, filed Oct. 11, 2007.
U.S. Appl. No. 11/951,626, filed Dec. 6, 2007.
U.S. Appl. No. 12/035,604, filed Feb. 22, 2008.
U.S. Appl. No. 11/745,713, filed May 8, 2007.
U.S. Appl. No. 11/601,504, filed Nov. 17, 2006.
U.S. Appl. No. 61/039,926, filed Mar. 27, 2008.

* cited by examiner

LIGHTING DEVICE AND METHOD OF LIGHTING

CROSS-REFERENCE TO RELATED APPLICATIONS

This application claims the benefit of U.S. Provisional Patent Application No. 60/809,595, filed May 31, 2006, the entirety of which is incorporated herein by reference.

FIELD OF THE INVENTION

The present invention is directed to a lighting device, more particularly, a lighting device which can readily be operated so as to change the overall intensity of the light output from the lighting device. In particular, the invention relates to lighting devices which comprise one or more solid state light emitters and which minimize or avoid color change when the overall intensity of the light output from the device is changed. The present invention is also directed to methods of changing the overall intensity of light output from lighting devices.

BACKGROUND OF THE INVENTION

A large proportion (some estimates are as high as twenty-five percent) of the electricity generated in the United States each year goes to lighting. Accordingly, there is an ongoing need to provide lighting which is more energy-efficient. It is well-known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have lifetimes between 50,000 and 70,000 hours). Fluorescent bulbs have longer lifetimes (e.g., 10,000-20,000 hours) than incandescent lights, but provide less favorable color reproduction.

Color reproduction is typically measured using the Color Rendering Index (CRI). CRI Ra is a modified average of the relative measurement of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator. Daylight has a high CRI (Ra of approximately 100), with incandescent bulbs also being relatively close (Ra greater than 95), and fluorescent lighting being less accurate (typical Ra of 70-80). Certain types of specialized lighting have very low CRI (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra).

Another issue faced by conventional light fixtures is the need to periodically replace the lighting devices (e.g., light bulbs, etc.). Such issues are particularly pronounced where access is difficult (e.g., vaulted ceilings, bridges, high buildings, traffic tunnels) and/or where change-out costs are extremely high. The typical lifetime of conventional fixtures is about 20 years, corresponding to a light-producing device usage of at least about 44,000 hours (based on usage of 6 hours per day for 20 years). Light-producing device lifetime is typically much shorter, thus creating the need for periodic change-outs.

Accordingly, for these and other reasons, efforts have been ongoing to develop ways by which solid state light emitters can be used in place of incandescent lights, fluorescent lights and other light-generating devices in a wide variety of applications. In addition, where light emitting diodes (or other solid state light emitters) are already being used, efforts are ongoing to provide light emitting diodes (or other solid state light emitters) which are improved, e.g., with respect to energy efficiency, color rendering index (CRI Ra), contrast, efficacy (1 m/W), and/or duration of service.

A variety of solid state light emitters are well-known. For example, one type of solid state light emitter is a light emitting diode.

Light emitting diodes are semiconductor devices that convert electrical current into light. A wide variety of light emitting diodes are used in increasingly diverse fields for an ever-expanding range of purposes.

More specifically, light emitting diodes are semiconducting devices that emit light (ultraviolet, visible, or infrared) when a potential difference is applied across a p-n junction structure. There are a number of well-known ways to make light emitting diodes and many associated structures, and the present invention can employ any such devices. By way of example, Chapters 12-14 of Sze, Physics of Semiconductor Devices, (2d Ed. 1981) and Chapter 7 of Sze, Modern Semiconductor Device Physics (1998) describe a variety of photonic devices, including light emitting diodes.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

As is well-known, a light emitting diode produces light by exciting electrons across the band gap between a conduction band and a valence band of a semiconductor active (light-emitting) layer. The electron transition generates light at a wavelength that depends on the band gap. Thus, the color of the light (wavelength) emitted by a light emitting diode depends on the semiconductor materials of the active layers of the light emitting diode.

Although the development of light emitting diodes has in many ways revolutionized the lighting industry, some of the characteristics of light emitting diodes have presented challenges, some of which have not yet been fully met. For example, the emission spectrum of any particular light emitting diode is typically concentrated around a single wavelength (as dictated by the light emitting diode's composition and structure), which is desirable for some applications, but not desirable for others, (e.g., for providing lighting, such an emission spectrum provides a very low CRI Ra).

Because light that is perceived as white is necessarily a blend of light of two or more colors (or wavelengths), no single light emitting diode junction has been developed that can produce white light. "White" LED lamps have been produced which have a light emitting diode pixel/cluster formed of respective red, green and blue light emitting diodes.

Another "white" LED lamp which has been produced includes (1) a light emitting diode which generates blue light and (2) a luminescent material (e.g., a phosphor) that emits yellow light in response to excitation by light emitted by the light emitting diode, whereby the blue light and the yellow light, when mixed, produce light that is perceived as white light.

In addition, the blending of primary colors to produce combinations of non-primary colors is generally well understood in this and other arts. In general, the 1931 CIE Chromaticity Diagram (an international standard for primary colors established in 1931), and the 1976 CIE Chromaticity Diagram (similar to the 1931 Diagram but modified such that similar distances on the Diagram represent similar perceived differences in color) provide useful reference for defining colors as weighted sums of primary colors.

The CRI Ra of efficient white LED lamps is generally low (in the range 65-75) as compared to incandescent light sources (CRI Ra of approximately 100). Additionally, the color temperature for LEDs is generally "cooler" (~5500K) and less desirable than the color temperature of incandescent or CCFL bulbs (~2700K). Both of these deficiencies in LEDs can be improved by the addition of other LEDs or lumiphors of selected saturated colors. As indicated above, light sources according to the present invention can utilize specific color "blending" of light sources of specific (x,y) color chromaticity coordinates (see U.S. Patent Application No. 60/752,555, filed Dec. 21, 2005, entitled "Lighting Device and Lighting Method" (inventors: Antony Paul Van de Ven and Gerald H. Negley), the entirety of which is hereby incorporated by reference). For example, light from additional selected saturated sources can be mixed with the unsaturated broad spectrum source(s) to provide uniform illumination without any areas of discoloration; and if desired, for cosmetic reasons, the individual light emitters can be made to be not visible as discreet devices or discreet color areas when the illumination source or aperture is viewed directly.

Light emitting diodes can thus be used individually or in any combinations, optionally together with one or more luminescent material (e.g., phosphors or scintillators) and/or filters, to generate light of any desired perceived color (including white). Accordingly, the areas in which efforts are being made to replace existing light sources with light emitting diode light sources, e.g., to improve energy efficiency, color rendering index (CRI Ra), efficacy (1 m/W), and/or duration of service, are not limited to any particular color or color blends of light.

Aspects related to the present invention can be represented on either the 1931 CIE (Commission International de I'Eclairage) Chromaticity Diagram or the 1976 CIE Chromaticity Diagram. FIG. 1 shows the 1931 CIE Chromaticity Diagram. FIG. 2 shows the 1976 Chromaticity Diagram. FIG. 3 shows an enlarged portion of the 1976 Chromaticity Diagram, in order to show the blackbody locus in more detail. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). For a technical description of CIE chromaticity diagrams, see, for example, "Encyclopedia of Physical Science and Technology", vol. 7, 230-231 (Robert A Meyers ed., 1987). The spectral colors are distributed around the edge of the outlined space, which includes all of the hues perceived by the human eye. The boundary line represents maximum saturation for the spectral colors. As noted above, the 1976 CIE Chromaticity Diagram is similar to the 1931 Diagram, except that the 1976 Diagram has been modified such that similar distances on the Diagram represent similar perceived differences in color.

In the 1931 Diagram, deviation from a point on the Diagram can be expressed either in terms of the coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues which would each be perceived as differing from the specified hue to a common extent (and likewise for loci of points defined as being spaced from a particular hue by other quantities of MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$, and the hues defined by a locus of points which are each a common distance from a specified hue consist of hues which would each be perceived as differing from the specified hue to a common extent.

The chromaticity coordinates and the CIE chromaticity diagrams illustrated in FIGS. 1-3 are explained in detail in a number of books and other publications, such as pages 98-107 of K. H. Butler, "Fluorescent Lamp Phosphors" (The Pennsylvania State University Press 1980) and pages 109-110 of G. Blasse et al., "Luminescent Materials" (Springer-Verlag 1994), both incorporated herein by reference.

The chromaticity coordinates (i.e., color points) that lie along the blackbody locus obey Planck's equation: $E(\lambda)=\lambda^{-5}/(e^{(B/T)}-1)$, where E is the emission intensity, $\lambda$ is the emission wavelength, T the color temperature of the blackbody and A and B are constants. Color coordinates that lie on or near the blackbody locus yield pleasing white light to a human observer. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants which produce light which is on or near the blackbody locus can thus be described in terms of their color temperature.

Also depicted on the 1976 CIE Diagram are designations A, B, C, D and E, which refer to light produced by several standard illuminants correspondingly identified as illuminants A, B, C, D and E, respectively.

A wide variety of luminescent materials (also known as lumiphors or luminophoric media, e.g., as disclosed in U.S. Pat. No. 6,600,175, the entirety of which is hereby incorporated by reference) are well-known and available to persons of skill in the art. For example, a phosphor is a luminescent material that emits a responsive radiation (e.g., visible light) when excited by a source of exciting radiation. In many instances, the responsive radiation has a wavelength which is different from the wavelength of the exciting radiation. Other examples of luminescent materials include scintillators, day glow tapes and inks which glow in the visible spectrum upon illumination with ultraviolet light.

Luminescent materials can be categorized as being down-converting, i.e., a material which converts photons to a lower energy level (longer wavelength) or up-converting, i.e., a material which converts photons to a higher energy level (shorter wavelength).

Inclusion of luminescent materials in LED devices has been accomplished by adding the luminescent materials to a clear or substantially transparent material (e.g., epoxy-based, silicone-based, glass-based or metal oxide-based material) as discussed above, for example by a blending or coating process.

For example, U.S. Pat. No. 6,963,166 (Yano '166) discloses that a conventional light emitting diode lamp includes a light emitting diode chip, a bullet-shaped transparent housing to cover the light emitting diode chip, leads to supply current to the light emitting diode chip, and a cup reflector for reflecting the emission of the light emitting diode chip in a uniform direction, in which the light emitting diode chip is encapsulated with a first resin portion, which is further encapsulated with a second resin portion. According to Yano '166, the first resin portion is obtained by filling the cup reflector with a resin material and curing it after the light emitting diode chip has been mounted onto the bottom of the cup reflector and then has had its cathode and anode electrodes electrically connected to the leads by way of wires. According to Yano '166, a phosphor is dispersed in the first resin portion so as to be excited with the light A that has been emitted from the light emitting diode chip, the excited phosphor produces fluorescence ("light B") that has a longer wavelength than the light A, a portion of the light A is transmitted through the first resin portion including the phosphor, and as a result, light C, as a mixture of the light A and light B, is used as illumination.

As noted above, "white LED lights" (i.e., lights which are perceived as being white or near-white) have been investigated as potential replacements for white incandescent lamps. A representative example of a white LED lamp includes a package of a blue light emitting diode chip, made of indium gallium nitride (InGaN) or gallium nitride (GaN), coated with a phosphor such as YAG. In such an LED lamp, the blue light emitting diode chip produces an emission with a peak wavelength of about 450 nm, and the phosphor produces yellow fluorescence with a peak wavelength of about 550 nm on receiving that emission. For instance, in some designs, white light emitting diode lamps are fabricated by forming a ceramic phosphor layer on the output surface of a blue light-emitting semiconductor light emitting diode. Part of the blue ray emitted from the light emitting diode chip passes through the phosphor, while part of the blue ray emitted from the light emitting diode chip is absorbed by the phosphor, which becomes excited and emits a yellow ray. The part of the blue light emitted by the light emitting diode which is transmitted through the phosphor is mixed with the yellow light emitted by the phosphor. The viewer perceives the mixture of blue and yellow light as white light. Another type uses a blue or violet light emitting diode chip which is combined with phosphor materials that produce red or orange and green or yellowish-green light rays. In such a lamp, part of the blue or violet light emitted by the light emitting diode chip excites the phosphors, causing the phosphors to emit red or orange and yellow or green light rays. These rays, combined with the blue or violet rays, can produce the perception of white light.

As also noted above, in another type of LED lamp, a light emitting diode chip that emits an ultraviolet ray is combined with phosphor materials that produce red (R), green (G) and blue (B) light rays. In such an LED lamp, the ultraviolet ray that has been radiated from the light emitting diode chip excites the phosphor, causing the phosphor to emit red, green and blue light rays which, when mixed, are perceived by the human eye as white light. Consequently, white light can also be obtained as a mixture of these light rays.

There is an ongoing need for ways to use solid state light emitters, e.g., light emitting diodes, in a wider variety of applications, with greater energy efficiency, with improved color rendering index (CRI Ra), with improved efficacy (1 m/W), and/or with longer duration of service.

BRIEF SUMMARY OF THE INVENTION

It is considered desirable by many people to be able to incrementally dim lighting, i.e., to select from one of two or more set intensities, rather than to select from continuously variable intensity (e.g., as is the case where a rheostat is provided).

Solid state light emitters are generally non-linear with regard to output. Thus, with a lighting device which includes a plurality of groups of solid state light emitters (each group of emitters including one or more solid state light emitters), where some or all of the groups of emitters emit a different color (or shade) of light, if the voltage and/or the current of the energy supplied to the device (which is in turn supplied to each of the solid state light emitters in the device) is varied, the color point ((x, y) on a 1931 CIE chart of the mixed illumination (i.e., a mixture of the light from all of the groups of emitters, e.g., light perceived as white) and/or the color temperature will undesirably shift.

There is an ongoing need for a variety of choices in lighting devices which provide incremental dimming, which provide preset dimming ranges, and which do not produce variation in color temperature as the intensity is varied.

The expression "intensity" is used herein in accordance with its normal usage, i.e., to refer to the amount of light produced over a given area, and is measured in units such as candelas.

According to the present invention, there are provided devices and methods in which each group (i.e., each emitted color) of solid state light emitters have preset different values so as to maintain the perceived color of the mixed illumination substantially the same, even when the overall intensity of the light being emitted from lighting device is changed among preset values.

In a first aspect according to the present invention, there is provided a lighting device which comprises a first group of solid state light emitters, a second group of solid state light emitters, a first current regulator, and a second current regulator, the first group of solid state light emitters comprising at least one first group solid state light emitter, and the second group of solid state light emitters comprising at least one second group solid state light emitter.

In this first aspect of the present invention, the first current regulator is switchable among at least two first current regulator settings, and the second current regulator is switchable among at least two second current regulator settings.

In this first aspect of the present invention, the at least two first current regulator settings comprise a first current regulator first setting and a first current regulator second setting, and the at least two second current regulator settings comprise a second current regulator first setting and a second current regulator second setting, such that:

(1) if the lighting device is energized and the first current regulator is in the first current regulator first setting, a first group first current would be supplied to the first group solid state light emitter;

(2) if the lighting device is energized and the first current regulator is in the first current regulator second setting, a first group second current would be supplied to the first group solid state light emitter;

(3) if the lighting device is energized and the second current regulator is in the second current regulator first setting, a second group first current would be supplied to the second group solid state light emitter; and (4) if the lighting device is energized and the second current regulator is in the second current regulator second setting, a second group second current would be supplied to the second group solid state light emitter.

In this first aspect of the present invention, the first group first current differs from the second group first current, and the first group second current differs from the second group second current.

In some embodiments according to the first aspect of the present invention:

if the first group first current is supplied to each of the first group of solid state light emitters and the second group first current is supplied to each of the second group of solid state light emitters, a combined intensity of the first group of solid state light emitters is a first group first intensity and a combined intensity of the second group of solid state light emitters is a second group first intensity, if the first group second current is supplied to each of the first group of solid state light emitters and the second group second current is supplied to each of the second group of solid state light emitters, a combined intensity of the first group of solid state light emitters is a first group second intensity and a combined intensity of the second group of solid state light emitters is a second group second intensity, and a ratio of the first group first intensity to the second group first intensity differ's by not more than 5% from a ratio of the first group second intensity to the second group second intensity.

In some embodiments according to the first aspect of the present invention:

if the first group first current is supplied to each of the first group of solid state light emitters and the second group first current is supplied to each of the second group of solid state light emitters, a combined illumination from the first group of solid state light emitters and the second group of solid state light emitters would be perceived as white, and if the first group second current is supplied to each of the first group of solid state light emitters and the second group second current is supplied to each of the second group of solid state light emitters, a combined illumination from the first group of solid state light emitters and the second group of solid state light emitters would also be perceived as white.

In some embodiments according to the first aspect of the present invention:

if the first group first current is supplied to each of the first group of solid state light emitters and the second group first current is supplied to each of the second group of solid state light emitters, a combined illumination from the first group of solid state light emitters and the second group of solid state light emitters corresponds to a first point on a 1976 CIE diagram, the first point having a first correlated color temperature, if the first group second current is supplied to each of the first group of solid state light emitters and the second group second current is supplied to each of the second group of solid state light emitters, a combined illumination from the first group of solid state light emitters and the second group of solid state light emitters corresponds to a second point on the 1976 CIE diagram, the second point having a second correlated color temperature, the first correlated color temperature differing from the second correlated color temperature by not more than 4 MacAdam ellipses.

The expression "correlated color temperature" is used according to its well-known meaning to refer to the temperature of a blackbody that is, in a well-defined sense (i.e., can be readily and precisely determined by those skilled in the art), nearest in color.

In some embodiments according to the first aspect of the present invention:

if the first group first current is supplied to each of the first group of solid state light emitters and the second group first current is supplied to each of the second group of solid state light emitters, a combined illumination from the first group of solid state light emitters and the second group of solid state light emitters corresponds to a first point on a 1976 CIE diagram having coordinates u', v', if the first group second current is supplied to each of the first group of solid state light emitters and the second group second current is supplied to each of the second group of solid state light emitters, a combined illumination from the first group of solid state light emitters and the second group of solid state light emitters corresponds to a second point on the 1976 CIE diagram having coordinates u', v', and the first point is spaced from the second point by a distance such that delta u', v' (i.e., the square root of the sum of the square of the difference in u' plus the square of the difference in v') is not more than 0.005 on the 1976 CIE diagram.

In some embodiments according to the first aspect of the present invention:

the lighting device further comprises a third group of solid state light emitters, the third group of solid state light emitters comprising at least one third group solid state light emitter; and a third current regulator which is switchable among at least two third current regulator settings, and the at least two third current regulator settings comprise a third current regulator first setting and a third current regulator second setting;

such that:

(5) if the lighting device is energized and the third current regulator is in the third current regulator first setting, a third group first current would be supplied to the third group solid state light emitter; and (6) if the lighting device is energized and the third current regulator is in the third current regulator second setting, a third group second current would be supplied to the third group solid state light emitter;

the third group first current differs from the first group first current and differs from the second group first current, and the third group second current differs from the first group second current and differs from the second group second current.

In some embodiments according to the first aspect of the present invention, the first current regulator is switchable among at least three first current regulator settings, the at least three first current regulator settings comprising the first current regulator first setting, the first current regulator second setting, and a first current regulator third setting; and the second current regulator is switchable among at least three second current regulator settings, the at least three second current regulator settings comprising the second current regulator first setting, the second current regulator second setting and a second current regulator third setting;

such that:

(5) if the lighting device is energized and the first current regulator is in the first current regulator third setting, a first group third current would be supplied to the first group solid state light emitter; and (6) if the lighting device is energized and the second current regulator is in the second current regulator third setting, a second group third current would be supplied to the second group solid state light emitter; and the first group third current differs from the second group third current.

In some embodiments according to the first aspect of the present invention, the lighting device further comprises a master currents regulator which is switchable among at least two master currents regulator settings, the at least two master currents regulator settings comprising a master currents regulator first setting and a master currents regulator second setting, such that:

(1) if the master currents regulator is in the master currents regulator first setting, the first current regulator would be in the first current regulator first position and the second current regulator would be in the second current regulator first position, and (2) if the master currents regulator is in the master currents regulator second setting, the first current regulator would be in the first current regulator second position and the second current regulator would be in the second current regulator second position.

In some embodiments according to the first aspect of the present invention:

each of the first group solid state light emitters has a dominant wavelength within 20 nanometers of a first group wavelength; and each of the second group solid state light emitters has a dominant wavelength within 20 nanometer's of a second group wavelength.

In some embodiments according to the first aspect of the present invention:

the first group first current differs from the first group second current, differs from the second group first current, and differs from the second group second current, and the second group first current differs from the first group first current, differs from the first group second current, and differs from the second group second current.

In some embodiments according to the first aspect of the present invention:

(1) if the lighting device is energized and the first current regulator is in the first current regulator first setting, the first group first current would be supplied to each of the first group solid state light emitters;

(2) if the lighting device is energized and the first current regulator is in the first current regulator second setting, the first group second current would be supplied to each of the first group solid state light emitters;

(3) if the lighting device is energized and the second current regulator is in the second current regulator first setting, the second group first current would be supplied to each of the second group solid state light emitters; and (4) if the lighting device is energized and the second current regulator is in the second current regulator second setting, the second group second current would be supplied to each of the second group solid state light emitters.

In a second aspect according to the present invention, there is provided a lighting device which comprises a first group of solid state light emitters, a second group of solid state light emitters, a first current regulator, and a second current regulator, the first group of solid state light emitters comprising at least one first group solid state light emitter, and the second group of solid state light emitters comprising at least one second group solid state light emitter.

In this second aspect of the present invention, the first current regulator is switchable among at least two first current regulator settings, and the second current regulator is switchable among at least two second current regulator settings.

In this second aspect of the present invention, the at least two first current regulator settings comprise a first current regulator first setting and a first current regulator second setting, and the at least two second current regulator settings comprise a second current regulator first setting and a second current regulator second setting, such that:

(1) if the lighting device is energized and the first current regulator is in the first current regulator first setting, a first group first current would be supplied to the first group solid state light emitter;

(2) if the lighting device is energized and the first current regulator is in the first current regulator second setting, a first group second current would be supplied to the first group solid state light emitter;

(3) if the lighting device is energized and the second current regulator is in the second current regulator first setting, a second group first current would be supplied to the second group solid state light emitter; and (4) if the lighting device is energized and the second current regulator is in the second current regulator second setting, a second group second current would be supplied to the second group solid state light emitter.

In this second aspect of the present invention, a first group second setting/first setting ratio differs from a second group second setting/first setting ratio by at least 5%, the first group second setting/first setting ratio being defined as the first group second current divided by the first group first current, the second group second setting/first setting ratio being defined as the second group second current divided by the second group first current.

In some embodiments according to the second aspect of the present invention:

if the first group first current is supplied to each of the first group of solid state light emitters and the second group first current is supplied to each of the second group of solid state light emitters, a combined intensity of the first group of solid state light emitters is a first group first intensity and a combined intensity of the second group of solid state light emitters is a second group first intensity, if the first group second current is supplied to each of the first group of solid state light emitters and the second group second current is supplied to each of the second group of solid state light emitters, a combined intensity of the first group of solid state light emitters is a first group second intensity and a combined intensity of the second group of solid state light emitters is a second group second intensity, and a ratio of the first group first intensity to the second group first intensity differs by not more than 5% from a ratio of the first group second intensity to the second group second intensity.

In some embodiments according to the second aspect of the present invention:

if the first group first current is supplied to each of the first group of solid state light emitters and the second group first current is supplied to each of the second group of solid state light emitters, a combined illumination from the first group of solid state light emitters and the second group of solid state light emitters would be perceived as white, and if the first group second current is supplied to each of the first group of solid state light emitters and the second group second current is supplied to each of the second group of solid state light emitters, a combined illumination from the first group of solid state light emitters and the second group of solid state light emitters would also be perceived as white.

In some embodiments according to the second aspect of the present invention:

if the first group first current is supplied to each of the first group of solid state light emitters and the second group first current is supplied to each of the second group of solid state light emitters, a combined illumination from the first group of solid state light emitters and the second group of solid state light emitters corresponds to a first point on a 1976 CIE diagram, the first point having a first correlated color temperature, if the first group second current is supplied to each of the first group of solid state light emitters and the second group second current is supplied to each of the second group of solid state light emitters, a combined illumination from the first group of solid state light emitters and the second group of solid state light emitters corresponds to a second point on the 1976 CIE diagram, the second point having a second correlated color temperature, the first correlated color temperature differing from the second correlated color temperature by not more than 4 MacAdam ellipses.

In some embodiments according to the second aspect of the present invention:

if the first group first current is supplied to each of the first group of solid state light emitters and the second group first current is supplied to each of the second group of solid state light emitters, a combined illumination from the first group of solid state light emitters and the second group of solid state light emitters corresponds to a first point on a 1976 CIE diagram having coordinates u', v', if the first group second current is supplied to each of the first group of solid state light emitters and the second group second current is supplied to each of the second group of solid state light emitters, a combined illumination from the first group of solid state light emitters and the second group of solid state light emitters corresponds to a second point on the 1976 CIE diagram having coordinates u', v', and the first point is spaced from the second point by a distance such that delta u', v' is not more than 0.005 on the 1976 CIE diagram.

In some embodiments according to the second aspect of the present invention, the lighting device further comprises:

a third group of solid state light emitters, the third group of solid state light emitters comprising at least one third group solid state light emitter; and a third current regulator; and the third current regulator is switchable among at least two third current regulator settings, the at least two third current regulator settings comprising a third current regulator first setting and a third current regulator second setting, such that:

(5) if the lighting device is energized and the third current regulator is in the third current regulator first setting, a third group first current would be supplied to the third group solid state light emitter; and (6) if the lighting device is energized and the third current regulator is in the third current regulator second setting, a third group second current would be supplied to the third group solid state light emitter; and a third group second setting/first setting ratio differs from the first group second setting/first setting ratio by at least 5%, and differs from the second group second setting/first setting ratio by at least 5%, the a third group second setting/first setting ratio being defined as the third group second current divided by the third group first current.

In some embodiments according to the second aspect of the present invention:

the first current regulator is switchable among at least three first current regulator settings, the at least three first current regulator settings comprising the first current regulator first setting, the first current regulator second setting, and a first current regulator third setting; and the second current regulator is switchable among at least three second current regulator settings, the at least three second current regulator settings comprising the second current regulator first setting, the second current regulator second setting and a second current regulator third setting;

such that:

(5) if the lighting device is energized and the first current regulator is in the first current regulator third setting, a first group third current would be supplied to the first group solid state light emitter; and (6) if the lighting device is energized and the second current regulator is in the second current regulator third setting, a second group third current would be supplied to the second group solid state light emitter;

a first group third setting/second setting ratio differing from a second group third setting/second setting ratio by at least 5%, the first group third setting/second setting ratio being defined as the first group third current divided by the first group second current, the second group third setting/second setting ratio being defined as the second group third current divided by the second group second current.

In some embodiments according to the second aspect of the present invention, the lighting device further comprises a master currents regulator, the master currents regulator being switchable among at least two master currents regulator settings, the at least two master currents regulator settings comprising a master currents regulator first setting and a master currents regulator second setting, such that:

(1) if the master currents regulator is in the master currents regulator first setting, the first current regulator would be in the first current regulator first position and the second current regulator would be in the second current regulator first position, and (2) if the master currents regulator is in the master currents regulator second setting, the first current regulator would be in the first current regulator second position and the second current regulator would be in the second current regulator second position.

In some embodiments according to the second aspect of the present invention:

each of the first group solid state light emitters has a dominant wavelength within 20 nanometers of a first group wavelength; and each of the second group solid state light emitters has a dominant wavelength within 20 nanometers of a second group wavelength.

In some embodiments according to the second aspect of the present invention:

(1) if the lighting device is energized and the first current regulator is in the first current regulator first setting, the first group first current would be supplied to each of the first group solid state light emitters;

(2) if the lighting device is energized and the first current regulator is in the first current regulator second setting, the first group second current would be supplied to each of the first group solid state light emitters;

(3) if the lighting device is energized and the second current regulator is in the second current regulator first setting, the second group first current would be supplied to each of the second group solid state light emitters; and (4) if the lighting device is energized and the second current regulator is in the second current regulator second setting, the second group second current would be supplied to each of the second group solid state light emitters.

In a third aspect according to the present invention, there is provided a method of lighting, comprising substantially simultaneously:

adjusting a current supplied to a first group of solid state light emitters from a first group first current to a first group second current; and adjusting a current supplied to a second group of solid state light emitters from a second group first current to a second group second current.

The expression "substantially simultaneously", as used herein, means that the respective events each occur within a short period of time of each other, e.g., spaced by not more than one second, e.g., spaced by not more than 0.1 second, even though such events may occur sequentially.

The expression "substantially transparent", as used herein, means that the structure which is characterized as being substantially transparent allows passage of at least 90% of incident visible light.

In this third aspect of the present invention, the first group of solid state light emitters comprises at least one first group solid state light emitter, and the second group of solid state light emitters comprises at least one second group solid state light emitter.

In addition, in this third aspect of the present invention, the first group first current differs from the second group first current, and the first group second current differs from the second group second current.

In a fourth aspect according to the present invention, there is provided a method of lighting, comprising substantially simultaneously:

adjusting a current supplied to a first group of solid state light emitters from a first group first current to a first group second current; and adjusting a current supplied to a second group of solid state light emitters from a second group first current to a second group second current.

In this fourth aspect of the present invention, the first group of solid state light emitters comprises at least one first group solid state light emitter, and the second group of solid state light emitters comprises at least one second group solid state light emitter.

In addition, in this fourth aspect of the present invention, a first group second setting/first setting ratio differs from a second group second setting/first setting ratio by at least 5%, the first group second setting/first setting ratio being defined as the first group second current divided by the first group first current, the second group second setting/first setting ratio being defined as the second group second current divided by the second group first current.

The invention may be more fully understood with reference to the accompanying drawings and the following detailed description of the invention.

BRIEF DESCRIPTION OF THE DRAWING FIGURES

DETAILED DESCRIPTION OF THE INVENTION

Figure 1:
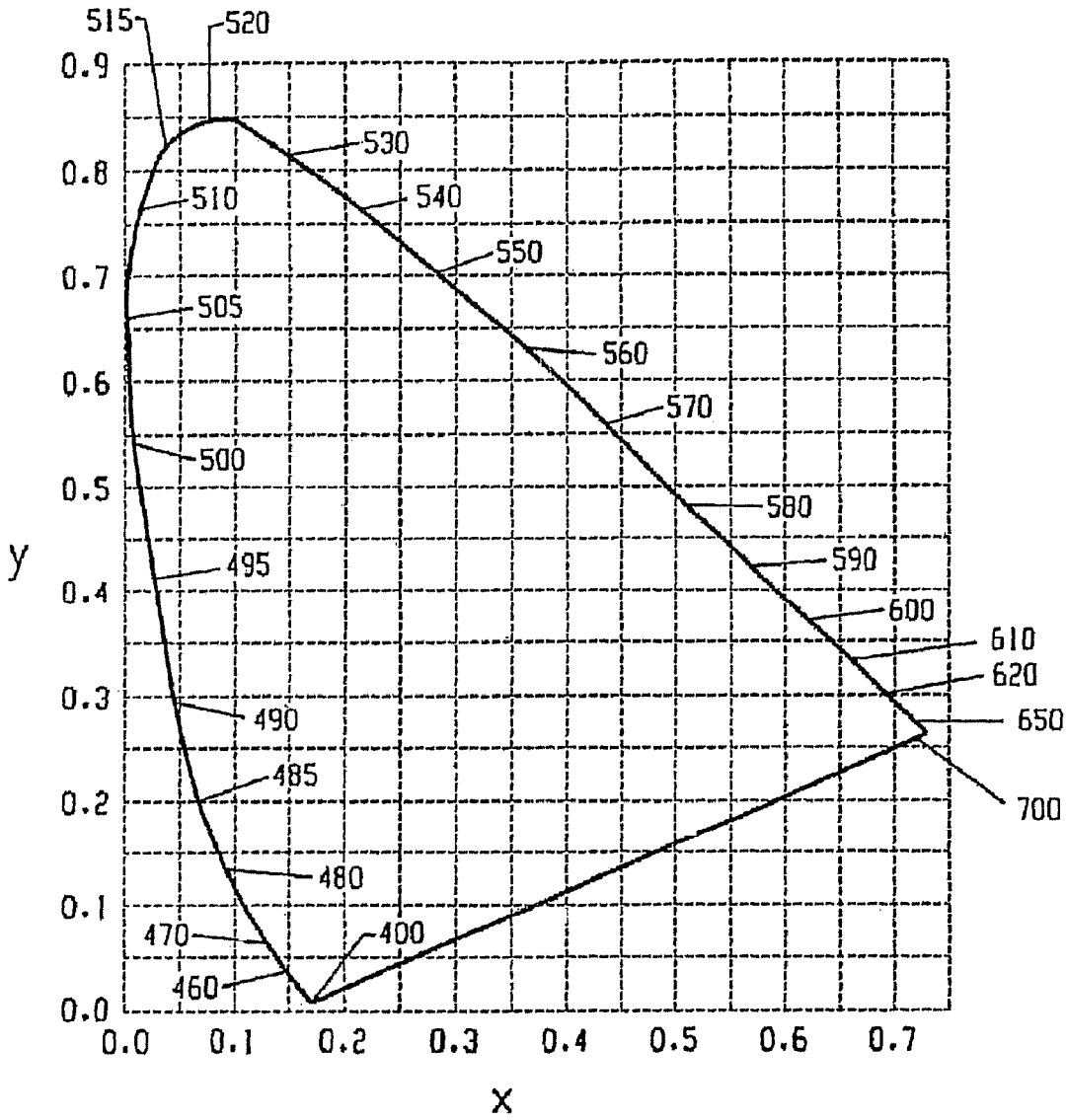
FIG. 1 shows the 1931 CIE Chromaticity Diagram.
Figure 2:
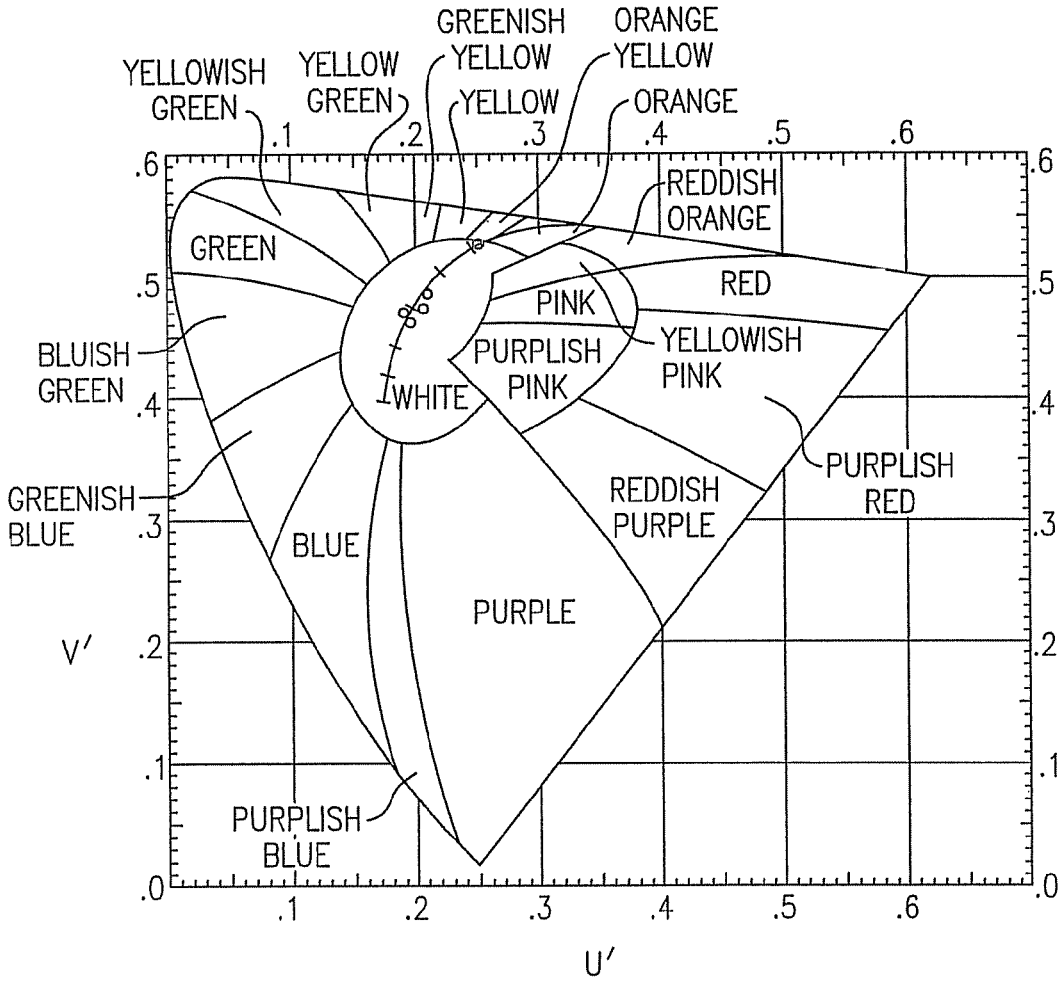
FIG. 2 shows the 1976 Chromaticity Diagram.
Figure 3:
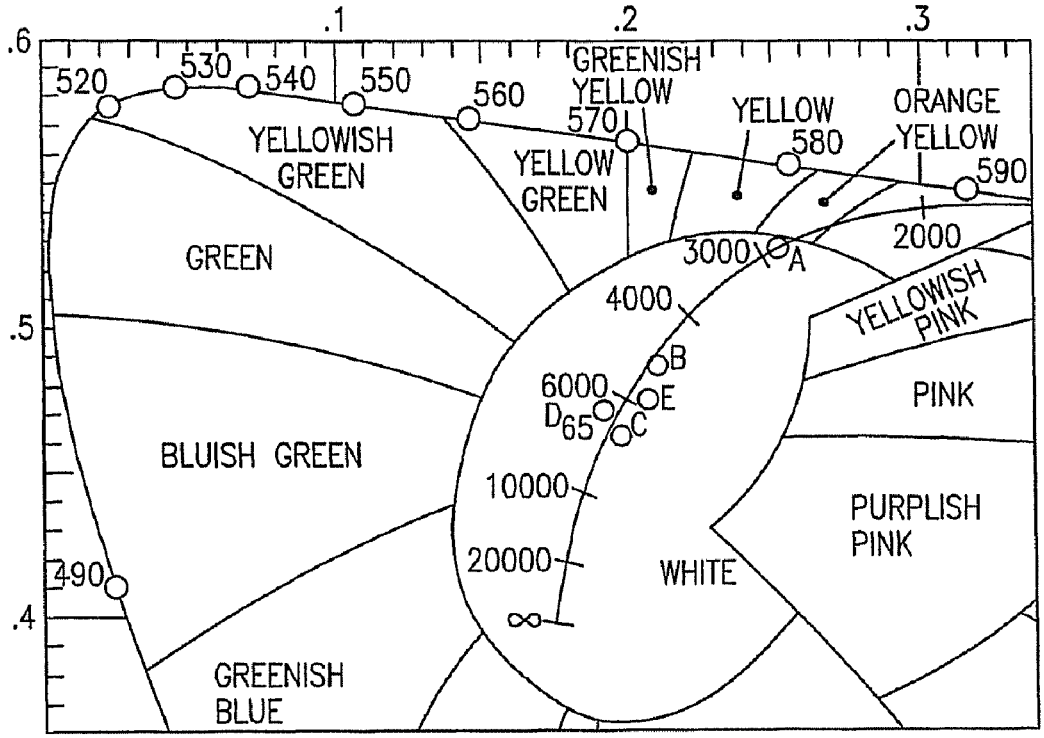
FIG. 3 shows an enlarged portion of the 1976 Chromaticity Diagram, in order to show the blackbody locus in detail.

As noted above, the lighting devices according to the present invention comprise a first group of solid state light emitters, a second group of solid state light emitters, a first current regulator, and a second current regulator.

The expression "illumination" (or "illuminated"), as used herein when referring to a solid state light emitter, means that at least some current is being supplied to the solid state light emitter to cause the solid state light emitter (and any associated lumiphor) to emit at least some light. The expression "illuminated" encompasses situations where the solid state light emitter emits light continuously or intermittently at a rate such that a human eye would perceive it as emitting light continuously, or where a plurality of solid state light emitters of the same color or different colors are emitting light intermittently and/or alternatingly (with or without overlap in "on" times) in such a way that a human eye would perceive them as emitting light continuously (and, in cases where different colors are emitted, as a mixture of those colors).

The expression "excited", as used herein when referring to a lumiphor, means that at least some electromagnetic radiation (e.g., visible light, UV light or infrared light) is contacting the lumiphor, causing the lumiphor to emit at least some light. The expression "excited" encompasses situations where the lumiphor emits light continuously or intermittently at a rate such that a human eye would perceive it as emitting light continuously, or where a plurality of lumiphors of the same color or different colors are emitting light intermittently and/or alternatingly (with or without overlap in "on" times) in such a way that a human eye would perceive them as emitting light continuously (and, in cases where different colors are emitted, as a mixture of those colors).

Any desired solid state light emitter or emitters can be employed in accordance with the present invention. Persons of skill in the art are aware of, and have ready access to, a wide variety of such emitters. Such solid state light emitters include inorganic and organic light emitters. Examples of types of such light emitters include a wide variety of light emitting diodes (inorganic or organic, including polymer light emitting diodes (PLEDs)), laser diodes, thin film electroluminescent devices, light emitting polymers (LEPs), a variety of each of which are well-known in the art (and therefore it is not necessary to describe in detail such devices, and/or the materials out of which such devices are made).

The respective light emitters can be similar to one another, different from one another, or any combination (i.e., there can be a plurality of solid state light emitters of one type, or one or more solid state light emitters of each of two or more types)

As noted above, one type of solid state light emitter which can be employed are LEDs. Such LEDs can be selected from among any light emitting diodes (a wide variety of which are readily obtainable and well known to those skilled in the art, and therefore it is not necessary to describe in detail such devices, and/or the materials out of which such devices are made). For instance, examples of types of light emitting diodes include inorganic and organic light emitting diodes, a variety of each of which are well-known in the art.

Representative examples of such LEDs, many of which are known in the art, can include lead frames, lumiphors, encapsulant regions, etc.

Representative examples of suitable LEDs are described in:

(1) U.S. Patent Application No. 60/753,138, filed on Dec. 22, 2005, entitled "Lighting Device" (inventor: Gerald H. Negley), the entirety of which is hereby incorporated by reference;

(2) U.S. Patent Application No. 60/794,379, filed on Apr. 24, 2006, entitled "Shifting Spectral Content in LEDs by Spatially Separating Lumiphor Films" (inventors: Gerald H. Negley and Antony Paul van de Ven), the entirety of which is hereby incorporated by reference;

(3) U.S. Patent Application No. 60/808,702, filed on May 26, 2006, entitled "Lighting Device" (inventors: Gerald H. Negley and Antony Paul van de Ven), the entirety of which is hereby incorporated by reference;

(4) U.S. Patent Application No. 60/808,925, filed on May 26, 2006, entitled "Solid State Light Emitting Device and Method of Making Same" (inventors: Gerald H. Negley and Neal Hunter), the entirety of which is hereby incorporated by reference;

(5) U.S. Patent Application No. 60/802,697, filed on May 23, 2006, entitled "Lighting Device and Method of Making" (inventor: Gerald H. Negley), the entirety of which is hereby incorporated by reference;

(6) U.S. Patent Application No. 60/839,453, filed on Aug. 23, 2006, entitled "LIGHTING DEVICE AND LIGHTING METHOD" (inventors: Antony Paul van de Ven and Gerald H. Negley), the entirety of which is hereby incorporated by reference;

(7) U.S. Patent Application No. 60/857,305, filed on Nov. 7, 2006, entitled "LIGHTING DEVICE AND LIGHTING METHOD" (inventors: Antony Paul van de Ven and Gerald H. Negley, the entirety of which is hereby incorporated by reference;

(8) U.S. Patent Application No. 60/851,230, filed on Oct. 12, 2006, entitled "LIGHTING DEVICE AND METHOD OF MAKING SAME" (inventor: Gerald H. Negley, the entirety of which is hereby incorporated by reference.

The lighting devices according to the present invention can comprise any desired number of solid state emitters.

As noted above, in some embodiments according to the first aspect of the present invention, the lighting device further comprises one or more lumiphors.

As noted above, in some embodiments according to the present invention, the lighting device further comprises at least one lumiphor (i.e., luminescence region or luminescent element which comprises at least one luminescent material). The expression "lumiphor", as used herein, refers to any luminescent element, i.e., any element which includes a luminescent material.

The one or more lumiphors, when provided, can individually be any lumiphor, a wide variety of which are known to those skilled in the art. For example, the one or more luminescent materials in the lumiphor can be selected from among phosphors, scintillators, day glow tapes, inks which glow in the visible spectrum upon illumination with ultraviolet light, etc. The one or more luminescent materials can be down-converting or up-converting, or can include a combination of both types. For example, the first lumiphor can comprise one or more down-converting luminescent materials.

The (or each of the) one or more lumiphors can, if desired, further comprise (or consist essentially of, or consist of) one or more highly transmissive (e.g., transparent or substantially transparent, or somewhat diffuse) binder, e.g., made of epoxy, silicone, glass, metal oxide, or any other suitable material (for example, in any given lumiphor comprising one or more binder, one or more phosphor can be dispersed within the one or more binder). In general, the thicker the lumiphor, the lower the weight percentage of the phosphor can be. Representative examples of the weight percentage of phosphor include from about 3.3 weight percent up to about 20 weight percent, although, as indicated above, depending on the overall thickness of the lumiphor, the weight percentage of the phosphor could be generally any value, e.g., from 0.1 weight percent to 100 weight percent (e.g., a lumiphor formed by subjecting pure phosphor to a hot isostatic pressing procedure).

Devices in which a lumiphor is provided can, if desired, further comprise one or more clear encapsulant (comprising, e.g., one or more silicone materials) positioned between the solid state light emitter (e.g., light emitting diode) and the lumiphor.

The (or each of the) one or more lumiphors can, independently, further comprise any of a number of well-known additives, e.g., diffusers, scatterer's, tints, etc.

In some embodiments according to the present invention, one or more of the light emitting diodes can be included in a package together with one or more of the lumiphors, and the one or more lumiphor in the package can be spaced from the one or more light emitting diode in the package to achieve improved light extraction efficiency, as described in U.S. Patent Application No. 60/753,138, filed on Dec. 22, 2005, entitled "Lighting Device" (inventor: Gerald H. Negley), the entirety of which is hereby incorporated by reference.

In some embodiments according to the present invention, two or more lumiphors can be provided, two or more of the lumiphors being spaced from each other, as described in U.S. Patent Application No. 60/761,310, filed on Jan. 23, 2006, entitled "Shifting Spectral Content in LEDs by Spatially Separating Lumiphor Films" (inventors: Gerald H. Negley and Antony Paul Van de Ven), the entirety of which is hereby incorporated by reference.

As noted above, the expression "groups" is used herein to refer to solid state light emitters which emit light of a particular color (or of a substantially similar color). For example, a particular group might include one or more solid state light emitters, each of which emit light having a dominant wavelength which is within 20 nanometers of a wavelength for that group.

In some embodiments of the present invention, a respective group includes all of the solid state light emitting devices included in the lighting device which have a dominant wavelength within a particular range of a particular value for that group, e.g., as a representative example, within 20 nm of 615 nm.

The current regulators employed in the lighting devices according to the present invention may be similar to one another or different from one another, and can be independently selected from among a wide variety of devices and components known to persons skilled in the art of electronics which can be used to regulate current. That is, any device which can be used to regulate the current passing through the solid state light emitter(s) can be employed, and skilled artisans are very familiar with, and have ready access to, a wide variety of such devices.

The current regulators can independently have any desired number of discrete settings. The expression "switchable among . . . regulator settings" encompasses devices (1) in which the current regulator setting is dictated by the physical location of one or more element, and (2) in which the current regulator setting is not dictated by a physical location of any element, e.g., it can be an operation mode, such as a digital control signal.

The lighting devices according to the present invention can include any desired number of groups of solid state light emitters, e.g., the devices can include just two groups of solid state light emitters, or can include a third group of solid state light emitters, or can include third and fourth and optionally fifth, sixth, seventh, etc. groups, along with at least one current regulator for each group.

As noted above, in some embodiments of the present invention, the lighting devices further include a master currents regulator. The master currents regulator, if employed, is switchable among at least two master currents regulator settings. Changing the setting of the master currents regulator causes the settings of one or more of the current regulators (for the two or more groups of solid state light emitters) to change (e.g., in a representative embodiment, if the master currents regulator is changed from a first setting to a second setting, the current regulators for some or all of the current regulators in the device are changed from their respective first settings to their respective second settings.

The expression "switchable among . . . regulator settings", as applied to a master currents regulator, as with current regulators, encompasses devices (1) in which the master currents regulator setting is dictated by the physical location of one or more element, and (2) in which the master currents regulator setting is not dictated by a physical location of any element, e.g., it can be an operation mode, such as a digital control signal.

In some embodiments, changing the master currents regulator from one setting to another setting causes each of the current regulators in the lighting device to move from a corresponding setting to another corresponding setting (e.g., all of the current regulators substantially simultaneously move to a lower current setting).

The expression "if the lighting device is energized" means supplying electrical current of any suitable form, from any suitable source to the lighting device in any suitable way. For example, current can be supplied to a lighting device by plugging a cord attached to the lighting device into an electrical outlet (e.g., a wall plug) which supplies alternating current (AC), and/or moving a switch in such cord to an "on" position. Alternatively or additionally, current supplied to the lighting device can be direct current (DC), and/or can be supplied from a battery, a photovoltaic device and/or any other suitable source. Additional components can be added, as desired, and persons of skill in the art are familiar with a variety of such devices, e.g., voltage regulators.

Solid state light emitters and any lumiphors can be selected so as to produce any desired mixtures of light.

Representative examples of suitable combinations of such components to provide desired light mixing are described in:

(1) U.S. Patent Application No. 60/752,555, filed Dec. 21, 2005, entitled "Lighting Device and Lighting Method" (inventors: Antony Paul Van de Ven and Gerald H. Negley), the entirety of which is hereby incorporated by reference;

(2) U.S. Patent Application No. 60/752,556, filed on Dec. 21, 2005, entitled "SIGN AND METHOD FOR LIGHTING" (inventors: Gerald H. Negley and Antony Paul van de Ven), the entirety of which is hereby incorporated by reference;

(3) U.S. Patent Application No. 60/793,524, filed on Apr. 20, 2006, entitled "LIGHTING DEVICE AND LIGHTING METHOD" (inventors: Gerald H. Negley and Antony Paul van de Ven), the entirety of which is hereby incorporated by reference;

(4) U.S. Patent Application No. 60/793,518, filed on Apr. 20, 2006, entitled "LIGHTING DEVICE AND LIGHTING METHOD" (inventors: Gerald H. Negley and Antony Paul van de Ven), the entirety of which is hereby incorporated by reference;

(5) U.S. Patent Application No. 60/793,530, filed on Apr. 20, 2006, entitled "LIGHTING DEVICE AND LIGHTING METHOD" (inventors: Gerald H. Negley and Antony Paul van de Ven), the entirety of which is hereby incorporated by reference;

(6) U.S. Pat. No. 7,213,940, issued on May 8, 2007, entitled "LIGHTING DEVICE AND LIGHTING METHOD" (inventors: Antony Paul van de Ven and Gerald H. Negley), the entirety of which is hereby incorporated by reference;

(7) U.S. Patent Application No. 60/868,134, filed on Dec. 1, 2006, entitled "LIGHTING DEVICE AND LIGHTING METHOD" (inventors: Antony Paul van de Ven and Gerald H. Negley), the entirety of which is hereby incorporated by reference;

(8) U.S. Patent Application No. 60/868,986, filed on Dec. 7, 2006, entitled "LIGHTING DEVICE AND LIGHTING METHOD" (inventors: Antony Paul van de Ven and Gerald H. Negley), the entirety of which is hereby incorporated by reference;

(9) U.S. Patent Application No. 60/857,305, filed on Nov. 7, 2006, entitled "LIGHTING DEVICE AND LIGHTING METHOD" (inventors: Antony Paul van de Ven and Gerald H. Negley, the entirety of which is hereby incorporated by reference; and

(10) U.S. Patent Application No. 60/891,148, filed on Feb. 22, 2007, entitled "LIGHTING DEVICE AND METHODS OF LIGHTING, LIGHT FILTERS AND METHODS OF FILTERING LIGHT" (inventor: Antony Paul van de Ven, the entirety of which is hereby incorporated by reference.

The expression "perceived as white", as used herein, means that normal human vision would perceive the light (i.e., the light which is characterized as being "perceived as white") as white.

The lighting devices of the present invention can be arranged, mounted and supplied with electricity in any desired manner, and can be mounted on any desired housing or fixture. Skilled artisans are familiar with a wide variety of arrangements, mounting schemes, power supplying apparatuses, housings and fixtures, and any such arrangements, schemes, apparatuses, housings and fixtures can be employed in connection with the present invention. The lighting devices of the present invention can be electrically connected (or selectively connected) to any desired power source, persons of skill in the art being familiar with a variety of such power sources.

Representative examples of arrangements of lighting devices, schemes for mounting lighting devices, apparatus for supplying electricity to lighting devices, housings for lighting devices, fixtures for lighting devices and power supplies for lighting devices, all of which are suitable for the lighting devices of the present invention, are described in:

(1) U.S. Patent Application No. 60/752,753, filed on Dec. 21, 2005, entitled "Lighting Device" (inventors: Gerald H.

Negley, Antony Paul van de Ven and Neal Hunter), the entirety of which is hereby incorporated by reference;

(2) U.S. Patent Application No. 60/798,446, filed on May 5, 2006, entitled "Lighting Device" (inventor: Antony Paul van de Ven), the entirety of which is hereby incorporated by reference;

(3) U.S. Patent Application No. 60/845,429, filed on Sep. 18, 2006, entitled "LIGHTING DEVICES, LIGHTING ASSEMBLIES, FIXTURES AND METHODS OF USING SAME" (inventor: Antony Paul van de Ven), the entirety of which is hereby incorporated by reference;

(4) U.S. Patent Application No. 60/846,222, filed on Sep. 21, 2006, entitled "LIGHTING ASSEMBLIES, METHODS OF INSTALLING SAME, AND METHODS OF REPLACING LIGHTS" (inventors: Antony Paul van de Ven and Gerald H. Negley), the entirety of which is hereby incorporated by reference;

(5) U.S. Patent Application No. 60/809,618, filed on May 31, 2006, entitled "LIGHTING DEVICE AND METHOD OF LIGHTING" (inventors: Gerald H. Negley, Antony Paul van de Ven and Thomas G. Coleman), the entirety of which is hereby incorporated by reference;

(6) U.S. Patent Application No. 60/858,881, filed on Nov. 14, 2006, entitled "LIGHT ENGINE ASSEMBLIES" (inventors: Paul Kenneth Pickard and Gary David Trott), the entirety of which is hereby incorporated by reference;

(7) U.S. Patent Application No. 60/859,013, filed on Nov. 14, 2006, entitled "LIGHTING ASSEMBLIES AND COMPONENTS FOR LIGHTING ASSEMBLIES" (inventors: Gary David Trott and Paul Kenneth Pickard), the entirety of which is hereby incorporated by reference; and (8) U.S. Patent Application No. 60/853,589, filed on Oct. 23, 2006, entitled "LIGHTING DEVICES AND METHODS OF INSTALLING LIGHT ENGINE HOUSINGS AND/OR TRIM ELEMENTS IN LIGHTING DEVICE HOUSINGS" (inventors: Gary David Trott and Paul Kenneth Pickard), the entirety of which is hereby incorporated by reference.

The expression "lighting device" as used herein is not limited, except that it is capable of emitting light. That is, a lighting device can be a device which illuminates an area or volume (e.g., a room, a swimming pool, a warehouse, an indicator, a road, a vehicle, a road sign, a billboard, a ship, a boat, an aircraft, a stadium, a tree, a window, a yard, etc.), an indicator light, or a device or array of devices that illuminate an enclosure, or a device that is used for edge or back-lighting (e.g., back light poster, signage, LCD displays), or any other light emitting device.

The present invention further relates to an illuminated enclosure (the volume of which can be illuminated uniformly or non-uniformly), comprising an enclosed space and at least one lighting device according to the present invention, wherein the lighting device illuminates at least a portion of the enclosure (uniformly or non-uniformly).

The present invention further relates to an illuminated surface, comprising a surface and at least one lighting device according to the present invention, wherein the lighting device illuminates at least a portion of the surface.

The present invention is further directed to an illuminated area, comprising at least one item selected from among the group consisting of a swimming pool, a room, a warehouse, an indicator, a road, a vehicle, a road sign, a billboard, a ship, a toy, a mirror, a vessel, an electronic device, a boat, an aircraft, a stadium, a computer, a remote audio device, a remote video device, a cell phone, a tree, a window, a yard, a lamppost, an indicator light, or a device or array of devices that illuminate an enclosure, or a device that is used for edge or back-lighting (e.g., back light poster, signage, LCD displays), having mounted therein or thereon at least one lighting device as described herein.

The devices according to the present invention can further comprise one or more long-life cooling device (e.g., a fan with an extremely high lifetime). Such long-life cooling device(s) can comprise piezoelectric or magnetorestrictive materials (e.g., MR, GMR, and/or HMR materials) that move air as a "Chinese fan". In cooling the devices according to the present invention, typically only enough air to break the boundary layer is required to induce temperature drops of 10 to 15 degrees C. Hence, in such cases, strong "breezes" or a large fluid flow rate (large CFM) are typically not required (thereby avoiding the need for conventional fans).

In some embodiments according to the present invention, any of the features, e.g., circuitry, as described in U.S. Patent Application No. 60/761,879, filed on Jan. 25, 2006, entitled "Lighting Device With Cooling" (inventors: Thomas Coleman, Gerald H. Negley and Antony Paul Van de Ven), the entirety of which is hereby incorporated by reference, can be employed.

The devices according to the present invention can further comprise secondary optics to further change the projected nature of the emitted light. Such secondary optics are well-known to those skilled in the art, and so they do not need to be described in detail herein—any such secondary optics can, if desired, be employed.

The devices according to the present invention can further comprise sensors or charging devices or cameras, etc. For example, persons of skill in the art are familiar with, and have ready access to, devices which detect one or more occurrence (e.g., motion detectors, which detect motion of an object or person), and which, in response to such detection, trigger illumination of a light, activation of a security camera, etc. As a representative example, a device according to the present invention can include a lighting device according to the present invention and a motion sensor, and can be constructed such that (1) while the light is illuminated, if the motion sensor detects movement, a security camera is activated to record visual data at or around the location of the detected motion, or (2) if the motion sensor detects movement, the light is illuminated to light the region near the location of the detected motion and the security camera is activated to record visual data at or around the location of the detected motion, etc.

Figure 4:
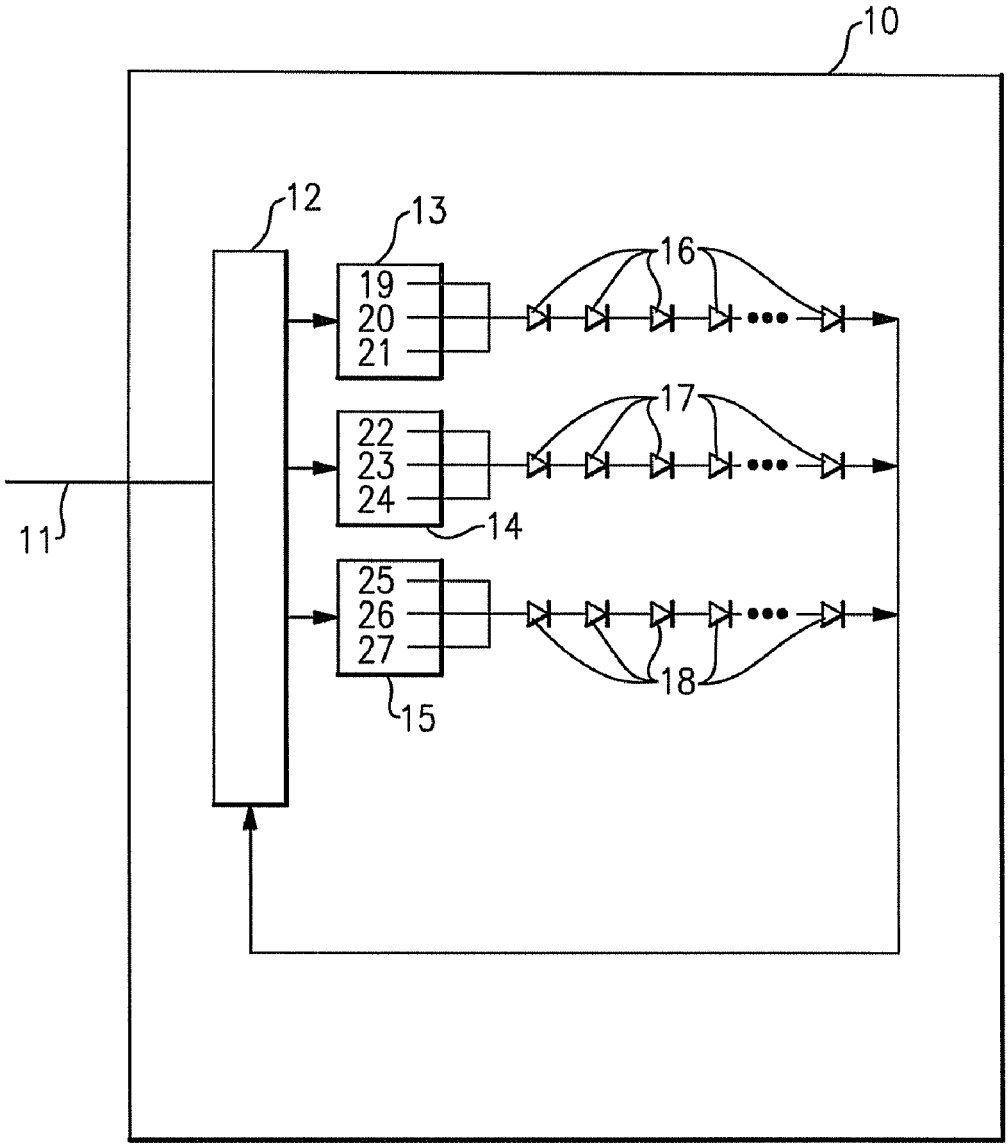
FIG. 4 depicts a first embodiment of a lighting device according to the present invention.

FIG. 4 is a schematic illustration of a first embodiment of a lighting device in accordance with the present invention.

Referring to FIG. 4, AC current is supplied to the lighting device 10 via a cord 11. The lighting device includes a master currents regulator 12 which is switchable among three settings, a first master currents setting, a second master currents setting and a third master currents setting. The lighting device also includes a first current regulator 13, a second current regulator 14 and a third current regulator 15. The first current regulator 13 is electrically connected to a first series of light emitting diodes 16 which emit red light, the second current regulator 14 is electrically connected to a second series of light emitting diodes 17 which emit blue light, some of which is converted by lumiphors (positioned adjacent to the respective light emitting diodes 17), such the output light is green, and the third current regulator 15 is electrically connected to a third series of light emitting diodes 18 which emit blue light.

The first current regulator 13 has three settings, a first current regulator first setting 19, a first current regulator second setting 20 and a first current regulator third setting 21.

The second current regulator 14 has three settings, a second current regulator first setting 22, a second current regulator second setting 23 and a second current regulator third setting 24.

The third current regulator 15 has three settings, a third current regulator first setting 25, a third current regulator second setting 26 and a third current regulator third setting 27.

When the master currents regulator 12 is in the first master currents setting, the first current regulator 13 is in the first current regulator first setting 19, the second current regulator 14 is in the second current regulator first setting 22 and the third current regulator 15 is in the third current regulator first setting 25.

When the master currents regulator 12 is in the second master currents setting, the first current regulator 13 is in the first current regulator second setting 20, the second current regulator 14 is in the second current regulator second setting 23 and the third current regulator 15 is in the third current regulator second setting 26.

When the master currents regulator 12 is in the third master currents setting, the first current regulator 13 is in the first current regulator third setting 21, the second current regulator 14 is in the second current regulator third setting 24 and the third current regulator 15 is in the third current regulator third setting 27.

When the first current regulator 13 is in the first current regulator first setting 19, the first current regulator 13 supplies current of 20 milliamps to the light emitting diodes 16 in the first series.

When the second current regulator 14 is in the second current regulator first setting 22, the second current regulator 14 supplies current of 20 milliamps to the light emitting diodes 17 in the second series.

When the third current regulator 15 is in the third current regulator first setting 25, the third current regulator 15 supplies current of 20 milliamps to the light emitting diodes 18 in the third series.

When the first current regulator 13 is in the first current regulator second setting 20, the first current regulator 13 supplies current of 15 milliamps to the light emitting diodes 16 in the first series.

When the second current regulator 14 is in the second current regulator second setting 23, the second current regulator 14 supplies current of 13 milliamps to the light emitting diodes 17 in the second series.

When the third current regulator 15 is in the third current regulator second setting 26, the third current regulator 15 supplies current of 11 milliamps to the light emitting diodes 18 in the third series.

When the first current regulator 13 is in the first current regulator third setting 21, the first current regulator 13 supplies current of 10 milliamps to the light emitting diodes 16 in the first series.

When the second current regulator 14 is in the second current regulator third setting 24, the second current regulator 14 supplies current of 6 milliamps to the light emitting diodes 17 in the second series.

When the third current regulator 15 is in the third current regulator third setting 27, the third current regulator 15 supplies current of 6 milliamps to the light emitting diodes 18 in the third series.

Figure 5:
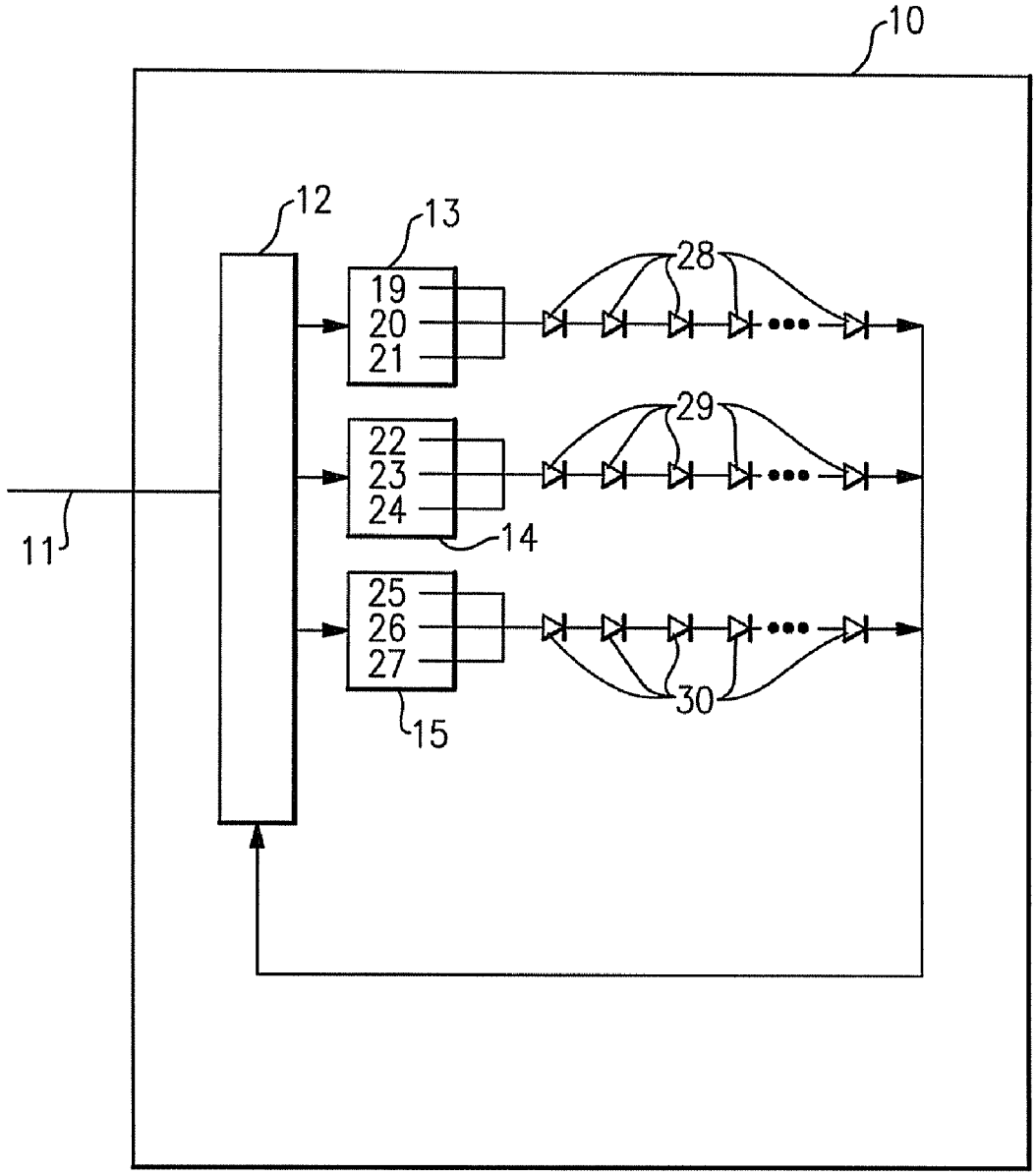
FIG. 5 depicts a second embodiment of a lighting device according to the present invention.

FIG. 5 is a schematic illustration of a second embodiment of a lighting device in accordance with the present invention.

The second embodiment is similar to the first embodiment, except that the second embodiment includes (1) a first series of light emitting diodes 28 which emit blue light, some of which is converted by lumiphors such that the output light is white (instead of the light emitting diodes 16 which emit red light), (2) a second series of light emitting diodes 29 which emit yellow light (instead of the light emitting diodes 17 and the associated lumiphors), and (3) a third series of light emitting diodes 30 which emit red light (instead of the light emitting diodes 18 which emit blue light).

Figure 6:
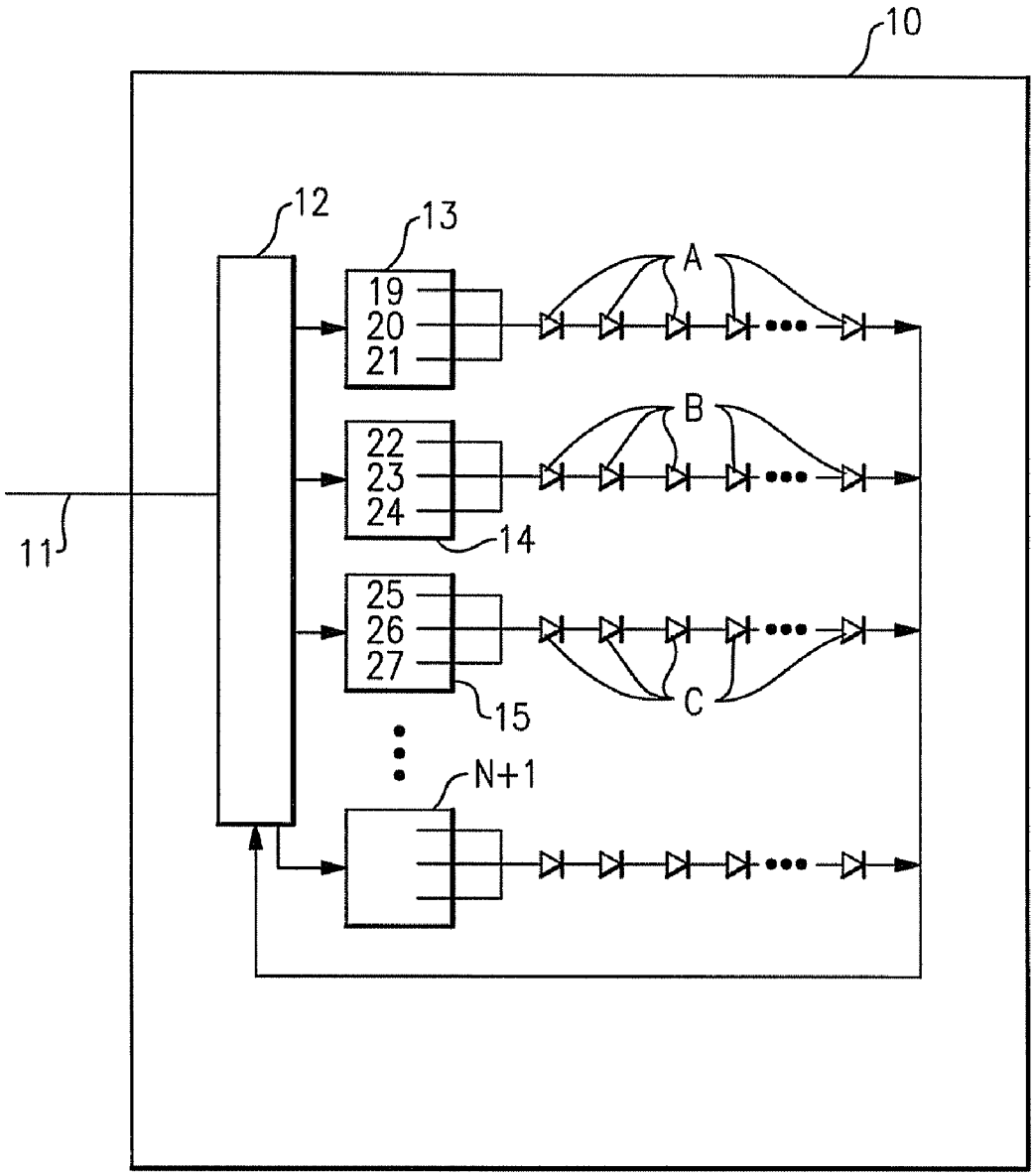
FIG. 6 depicts a third embodiment of a lighting device according to the present invention.

FIG. 6 is a schematic illustration of a third embodiment of a lighting device in accordance with the present invention.

The third embodiment is also similar to the first embodiment, except that the first series of light emitting diodes is represented as "A", the second series of light emitting diodes is represented as "B", and the third series of light emitting diodes is represented as "C", to signify that the first, second and third series of light emitters can be of any desired respective colors, and the third embodiment also includes a current regulator identified as "N+1" to indicate that the device can include any desired number of groups of solid state light emitters and associated current regulators. For example, in representative additional embodiments:

(1) "A" can signify a series emitters which emit white light, "B" can signify a series of emitters which emit yellow light, and "C" can signify emitters which emit red light;

(2) "A" can signify a series emitters which emit white light, "B" can signify a series of emitters which emit red light, and "C" can signify emitters which emit orange light; or (3) "A" can signify a series emitters which emit red light, "B" can signify a series of emitters which emit green light, and "C" can signify emitters which emit blue light.

A statement herein that two components in a device are "electrically connected," means that there are no components electrically between the components, the insertion of which materially affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected.

Any two or more structural parts of the lighting devices described herein can be integrated. Any structural part of the lighting devices described herein can be provided in two or more parts (which are held together, if necessary). Similarly, any two or more functions can be conducted simultaneously, and/or any function can be conducted in a series of steps.

The invention claimed is:

1. A lighting device, comprising:

a first group of solid state light emitters, said first group of solid state light emitters comprising at least one first group solid state light emitter;

a second group of solid state light emitters, said second group of solid state light emitters comprising at least one second group solid state light emitter;

a first current regulator; and a second current regulator;

said first current regulator being switchable among at least two first current regulator settings, said at least two first current regulator settings comprising a first current regulator first setting and a first current regulator second setting;

said second current regulator being switchable among at least two second current regulator settings, said at least two second current regulator settings comprising a second current regulator first setting and a second current regulator second setting;

such that:

(1) if said lighting device is energized and said first current regulator is in said first current regulator first setting, a first group first current would be supplied to said first group solid state light emitter;

(2) if said lighting device is energized and said first current regulator is in said first current regulator second setting, a first group second current would be supplied to said first group solid state light emitter;

(3) if said lighting device is energized and said second current regulator is in said second current regulator first setting, a second group first current would be supplied to said second group solid state light emitter; and (4) if said lighting device is energized and said second current regulator is in said second current regulator second setting, a second group second current would be supplied to said second group solid state light emitter;

said first group first current differing from said second group first current, said first group second current differing from said second group second current.

2. A lighting device as recited in claim 1, wherein:

if said first group first current is supplied to each of said first group of solid state light emitters and said second group first current is supplied to each of said second group of solid state light emitters, a combined intensity of said first group of solid state light emitters is a first group first intensity and a combined intensity of said second group of solid state light emitters is a second group first intensity, if said first group second current is supplied to each of said first group of solid state light emitters and said second group second current is supplied to each of said second group of solid state light emitters, a combined intensity of said first group of solid state light emitters is a first group second intensity and a combined intensity of said second group of solid state light emitters is a second group second intensity, and a ratio of said first group first intensity to said second group first intensity differs by not more than 5% from a ratio of said first group second intensity to said second group second intensity.

3. A lighting device as recited in claim 1, wherein:

if said first group first current is supplied to each of said first group of solid state light emitters and said second group first current is supplied to each of said second group of solid state light emitters, a combined illumination from said first group of solid state light emitters and said second group of solid state light emitters would be perceived as white, and if said first group second current is supplied to each of said first group of solid state light emitters and said second group second current is supplied to each of said second group of solid state light emitters, a combined illumination from said first group of solid state light emitters and said second group of solid state light emitters would also be perceived as white.

4. A lighting device as recited in claim 3, wherein if said first group first current is supplied to each of said first group of solid state light emitters and said second group first current is supplied to each of said second group of solid state light emitters, a combined illumination from said first group of solid state light emitters and said second group of solid state light emitters corresponds to a first point on a 1976 CIE diagram, said first point having a first correlated color temperature, if said first group second current is supplied to each of said first group of solid state light emitters and said second group second current is supplied to each of said second group of solid state light emitters, a combined illumination from said first group of solid state light emitters and said second group of solid state light emitters corresponds to a second point on said 1976 CIE diagram, said second point having a second correlated color temperature, said first correlated color temperature differing from said second correlated color temperature by not more than 4 MacAdam ellipses.

5. A lighting device as recited in claim 1, wherein:

if said first group first current is supplied to each of said first group of solid state light emitters and said second group first current is supplied to each of said second group of solid state light emitters, a combined illumination from said first group of solid state light emitters and said second group of solid state light emitters corresponds to a first point on a 1976 CIE diagram having coordinates u', v', if said first group second current is supplied to each of said first group of solid state light emitters and said second group second current is supplied to each of said second group of solid state light emitters, a combined illumination from said first group of solid state light emitters and said second group of solid state light emitters corresponds to a second point on said 1976 CIE diagram having coordinates u', v', and said first point is spaced from said second point by a distance such that delta u', v' is not more than 0.005 on the 1976 CIE diagram.

6. A lighting device as recited in claim 1, further comprising a third group of solid state light emitters, said third group of solid state light emitters comprising at least one third group solid state light emitter; and a third current regulator;

said third current regulator being switchable among at least two third current regulator settings, said at least two third current regulator settings comprising a third current regulator first setting and a third current regulator second setting;

such that:

(5) if said lighting device is energized and said third current regulator is in said third current regulator first setting, a third group first current would be supplied to said third group solid state light emitter; and (6) if said lighting device is energized and said third current regulator is in said third current regulator second setting, a third group second current would be supplied to said third group solid state light emitter;

said third group first current differing from said first group first current and differing from said second group first current, and said third group second current differing from said first group second current and differing from said second group second current.

7. A lighting device as recited in claim 1, wherein:

said first current regulator is switchable among at least three first current regulator settings, said at least three first current regulator settings comprising said first current regulator first setting, said first current regulator second setting, and a first current regulator third setting; and said second current regulator is switchable among at least three second current regulator settings, said at least three second current regulator settings comprising said second current regulator first setting, said second current regulator second setting and a second current regulator third setting;

such that:

(5) if said lighting device is energized and said first current regulator is in said first current regulator third setting, a first group third current would be supplied to said first group solid state light emitter; and (6) if said lighting device is energized and said second current regulator is in said second current regulator third setting, a second group third current would be supplied to said second group solid state light emitter;

said first group third current differing from said second group third current.

8. A lighting device as recited in claim 1, further comprising a master currents regulator, said master currents regulator being switchable among at least two master currents regulator settings, said at least two master currents regulator settings comprising a master currents regulator first setting and a master currents regulator second setting, such that:

(1) if said master currents regulator is in said master currents regulator first setting, said first current regulator would be in said first current regulator first position and said second current regulator would be in said second current regulator first position, and (2) if said master currents regulator is in said master currents regulator second setting, said first current regulator would be in said first current regulator second position and said second current regulator would be in said second current regulator second position.

9. A lighting device as recited in claim 1, wherein:

each of said first group solid state light emitters has a dominant wavelength within 20 nanometers of a first group wavelength; and each of said second group solid state light emitters has a dominant wavelength within 20 nanometers of a second group wavelength.

10. A lighting device as recited in claim 1, wherein:

said first group first current differs from said first group second current, differs from said second group first current, and differs from said second group second current, and said second group first current differs from said first group first current, differs from said first group second current, and differs from said second group second current.

11. A lighting device as recited in claim 1, wherein:

(1) if said lighting device is energized and said first current regulator is in said first current regulator first setting, said first group first current would be supplied to each of said first group solid state light emitters;

(2) if said lighting device is energized and said first current regulator is in said first current regulator second setting, said first group second current would be supplied to each of said first group solid state light emitters;

(3) if said lighting device is energized and said second current regulator is in said second current regulator first setting, said second group first current would be supplied to each of said second group solid state light emitters; and (4) if said lighting device is energized and said second current regulator is in said second current regulator second setting, said second group second current would be supplied to each of said second group solid state light emitters.

12. A lighting device, comprising:

a first group of solid state light emitters, said first group of solid state light emitters comprising at least one first group solid state light emitter;

a second group of solid state light emitters, said second group of solid state light emitters comprising at least one second group solid state light emitter;

a first current regulator; and a second current regulator;

said first current regulator being switchable among at least two first current regulator settings, said at least two first current regulator settings comprising a first current regulator first setting and a first current regulator second setting;

said second current regulator being switchable among at least two second current regulator settings, said at least two second current regulator settings comprising a second current regulator first setting and a second current regulator second setting;

such that:

(1) if said lighting device is energized and said first current regulator is in said first current regulator first setting, a first group first current would be supplied to said first group solid state light emitter;

(2) if said lighting device is energized and said first current regulator is in said first current regulator second setting, a first group second current would be supplied to said first group solid state light emitter;

(3) if said lighting device is energized and said second current regulator is in said second current regulator first setting, a second group first current would be supplied to said second group solid state light emitter; and (4) if said lighting device is energized and said second current regulator is in said second current regulator second setting, a second group second current would be supplied to said second group solid state light emitter;

a first group second setting/first setting ratio being defined as said first group second current divided by said first group first current, a second group second setting/first setting ratio being defined as said second group second current divided by said second group first current, said first group second setting/first setting ratio differing from said second group second setting/first setting ratio by at least 5%.

13. A lighting device as recited in claim 12, wherein:

if said first group first current is supplied to each of said first group of solid state light emitters and said second group first current is supplied to each of said second group of solid state light emitters, a combined intensity of said first group of solid state light emitters is a first group first intensity and a combined intensity of said second group of solid state light emitters is a second group first intensity, if said first group second current is supplied to each of said first group of solid state light emitters and said second group second current is supplied to each of said second group of solid state light emitters, a combined intensity of said first group of solid state light emitters is a first group second intensity and a combined intensity of said second group of solid state light emitters is a second group second intensity, and a ratio of said first group first intensity to said second group first intensity differs by not more than 5% from a ratio of said first group second intensity to said second group second intensity.

14. A lighting device as recited in claim 12, wherein:

if said first group first current is supplied to each of said first group of solid state light emitters and said second group first current is supplied to each of said second group of solid state light emitters, a combined illumination from said first group of solid state light emitters and said second group of solid state light emitters would be perceived as white, and if said first group second current is supplied to each of said first group of solid state light emitters and said second group second current is supplied to each of said second group of solid state light emitters, a combined illumination from said first group of solid state light emitters and said second group of solid state light emitters would also be perceived as white.

15. A lighting device as recited in claim 14, wherein if said first group first current is supplied to each of said first group of solid state light emitters and said second group first current is supplied to each of said second group of solid state light emitters, a combined illumination from said first group of solid state light emitters and said second group of solid state light emitters corresponds to a first point on a 1976 CIE diagram, said first point having a first correlated color temperature, if said first group second current is supplied to each of said first group of solid state light emitters and said second group second current is supplied to each of said second group of solid state light emitters, a combined illumination from said first group of solid state light emitters and said second group of solid state light emitters corresponds to a second point on said 1976 CIE diagram, said second point having a second correlated color temperature, said first correlated color temperature differing from said second correlated color temperature by not more than 4 MacAdam ellipses.

16. A lighting device as recited in claim 12, wherein:

if said first group first current is supplied to each of said first group of solid state light emitters and said second group first current is supplied to each of said second group of solid state light emitters, a combined illumination from said first group of solid state light emitters and said second group of solid state light emitters corresponds to a first point on a 1976 CIE diagram having coordinates u', v', if said first group second current is supplied to each of said first group of solid state light emitters and said second group second current is supplied to each of said second group of solid state light emitters, a combined illumination from said first group of solid state light emitters and said second group of solid state light emitters corresponds to a second point on said 1976 CIE diagram having coordinates u', v', and said first point is spaced from said second point by a distance such that delta u', v' is not more than 0.005 on the 1976 CIE diagram.

17. A lighting device as recited in claim 12, further comprising a third group of solid state light emitters, said third group of solid state light emitters comprising at least one third group solid state light emitter; and a third current regulator;

said third current regulator being switchable among at least two third current regulator settings, said at least two third current regulator settings comprising a third current regulator first setting and a third current regulator second setting;

such that:

(5) if said lighting device is energized and said third current regulator is in said third current regulator first setting, a third group first current would be supplied to said third group solid state light emitter; and (6) if said lighting device is energized and said third current regulator is in said third current regulator second setting, a third group second current would be supplied to said third group solid state light emitter;

a third group second setting/first setting ratio being defined as said third group second current divided by said third group first current, said third group second setting/first setting ratio differing from said first group second setting/first setting ratio by at least 5%, and differing from said second group second setting/first setting ratio by at least 5%.

18. A lighting device as recited in claim 12, wherein:

said first current regulator is switchable among at least three first current regulator settings, said at least three first current regulator settings comprising said first current regulator first setting, said first current regulator second setting, and a first current regulator third setting; and said second current regulator is switchable among at least three second current regulator settings, said at least three second current regulator settings comprising said second current regulator first setting, said second current regulator second setting and a second current regulator third setting;

such that:

(5) if said lighting device is energized and said first current regulator is in said first current regulator third setting, a first group third current would be supplied to said first group solid state light emitter; and (6) if said lighting device is energized and said second current regulator is in said second current regulator third setting, a second group third current would be supplied to said second group solid state light emitter;

a first group third setting/second setting ratio being defined as said first group third current divided by said first group second current, a second group third setting/second setting ratio being defined as said second group third current divided by said second group second current, said first group third setting/second setting ratio differing from said second group third setting/second setting ratio by at least 5%.

19. A lighting device as recited in claim 12, further comprising a master currents regulator, said master currents regulator being switchable among at least two master currents regulator settings, said at least two master currents regulator settings comprising a master currents regulator first setting and a master currents regulator second setting, such that:

(1) if said master currents regulator is in said master currents regulator first setting, said first current regulator would be in said first current regulator first position and said second current regulator would be in said second current regulator first position, and (2) if said master currents regulator is in said master currents regulator second setting, said first current regulator would be in said first current regulator second position and said second current regulator would be in said second current regulator second position.

20. A lighting device as recited in claim 12, wherein:

each of said first group solid state light emitters has a dominant wavelength within 20 nanometers of a first group wavelength; and each of said second group solid state light emitters has a dominant wavelength within 20 nanometers of a second group wavelength.

21. A lighting device as recited in claim 12, wherein:

(1) if said lighting device is energized and said first current regulator is in said first current regulator first setting, said first group first current would be supplied to each of said first group solid state light emitters;

(2) if said lighting device is energized and said first current regulator is in said first current regulator second setting, said first group second current would be supplied to each of said first group solid state light emitters;

(3) if said lighting device is energized and said second current regulator is in said second current regulator first setting, said second group first current would be supplied to each of said second group solid state light emitters; and (4) if said lighting device is energized and said second current regulator is in said second current regulator second setting, said second group second current would be supplied to each of said second group solid state light emitters.

22. A method of lighting, comprising:

substantially simultaneously:

(a) adjusting a current supplied to a first group of solid state light emitters from a first group first current to a first group second current; and (b) adjusting a current supplied to a second group of solid state light emitters from a second group first current to a second group second current;

said first group of solid state light emitters comprising at least one first group solid state light emitter;

said second group of solid state light emitters comprising at least one second group solid state light emitter;

said first group first current differing from said second group first current, said first group second current differing from said second group second current.

23. A method as recited in claim 22, wherein:

a combined intensity of said first group of solid state light emitters prior to said adjusting a current supplied to said first group of solid state light emitters is a first group first intensity, a combined intensity of said second group of solid state light emitters prior to said adjusting a current supplied to said second group of solid state light emitters is a second group first intensity, a combined intensity of said first group of solid state light emitters after said adjusting a current supplied to said first group of solid state light emitters is a first group second intensity, a combined intensity of said second group of solid state light emitters after said adjusting a current supplied to said second group of solid state light emitters is a second group second intensity, and a ratio of said first group first intensity to said second group first intensity differs by not more than 5% from a ratio of said first group second intensity to said second group second intensity.

24. A method as recited in claim 22, wherein:

a combined illumination from said first group of solid state light emitters and said second group of solid state light emitters prior to said adjusting a current supplied to said first group of solid state light emitters corresponds to a first point on a 1976 CIE diagram which has coordinates u', v', a combined illumination from said first group of solid state light emitters and said second group of solid state light emitters after said adjusting a current supplied to said first group of solid state light emitters corresponds to a second point on said 1976 CIE diagram which has coordinates u', v', and said first point is spaced from said second point by a distance such that delta u', v' is not more than 0.005 on the 1976 CIE diagram.

25. A method as recited in claim 22, wherein:

each of said first group solid state light emitters has a dominant wavelength within 20 nanometers of a first group wavelength; and each of said second group solid state light emitters has a dominant wavelength within 20 nanometers of a second group wavelength.

26. A method as recited in claim 22, wherein:

said first group first current differs from said first group second current, differs from said second group first current, and differs from said second group second current, and said second group first current differs from said first group first current, differs from said first group second current, and differs from said second group second current.

27. A method of lighting, comprising:

substantially simultaneously:

(a) adjusting a current supplied to a first group of solid state light emitters from a first group first current to a first group second current; and (b) adjusting a current supplied to a second group of solid state light emitters from a second group first current to a second group second current;

said first group of solid state light emitters comprising at least one first group solid state light emitter;

said second group of solid state light emitters comprising at least one second group solid state light emitter;

a first group second setting/first setting ratio being defined as said first group second current divided by said first group first current, a second group second setting/first setting ratio being defined as said second group second current divided by said second group first current, said first group second setting/first setting ratio differing from said second group second setting/first setting ratio by at least 5%.

28. A method as recited in claim 27, wherein:

a combined intensity of said first group of solid state light emitters prior to said adjusting a current supplied to said first group of solid state light emitters is a first group first intensity, a combined intensity of said second group of solid state light emitters prior to said adjusting a current supplied to said second group of solid state light emitters is a second group first intensity, a combined intensity of said first group of solid state light emitters after said adjusting a current supplied to said first group of solid state light emitters is a first group second intensity, a combined intensity of said second group of solid state light emitters after said adjusting a current supplied to said second group of solid state light emitters is a second group second intensity, and a ratio of said first group first intensity to said second group first intensity differs by not more than 5% from a ratio of said first group second intensity to said second group second intensity.

29. A method as recited in claim 27, wherein:

a combined illumination from said first group of solid state light emitters and said second group of solid state light emitters prior to said adjusting a current supplied to said first group of solid state light emitters corresponds to a first point on a 1976 CIE diagram which has coordinates u', v', a combined illumination from said first group of solid state light emitters and said second group of solid state light emitters after said adjusting a current supplied to said first group of solid state light emitters corresponds to a second point on said 1976 CIE diagram which has coordinates u', v', and said first point is spaced from said second point by a distance such that delta u', v' is not more than 0.005 on the 1976 CIE diagram.

30. A method as recited in claim 29, wherein said first point has first point u', v' coordinates and said second point has second point u', v' coordinates, said second point u', v' coordinates being identical to said first point u', v' coordinates.

31. A method as recited in claim 27, wherein:

each of said first group solid state light emitters has a dominant wavelength within 20 nanometers of a first group wavelength; and each of said second group solid state light emitters has a dominant wavelength within 20 nanometers of a second group wavelength.

32. A method as recited in claim 27, wherein:

said first group first current differs from said first group second current, differs from said second group first current, and differs from said second group second current, and said second group first current differs from said first group first current, differs from said first group second current, and differs from said second group second current.

* * * * *